US008544228B2

(12) United States Patent
Bronner

(10) Patent No.: US 8,544,228 B2
(45) Date of Patent: Oct. 1, 2013

(54) WINGED ANCHOR AND SPIKED SPACER FOR VENEER WALL TIE CONNECTION SYSTEM AND METHOD

(76) Inventor: Joseph Bronner, Warren, NJ (US)

( * ) Notice: Subject to any disclaimer, the term of this patent is extended or adjusted under 35 U.S.C. 154(b) by 117 days.

(21) Appl. No.: 12/896,455

(22) Filed: Oct. 1, 2010

(65) Prior Publication Data

US 2011/0094176 A1 Apr. 28, 2011

Related U.S. Application Data

(60) Provisional application No. 61/255,267, filed on Oct. 27, 2009.

(51) Int. Cl.
*E04B 1/16* (2006.01)

(52) U.S. Cl.
USPC ..... 52/378; 52/379; 52/513; 52/512; 52/508; 52/713

(58) Field of Classification Search
USPC ..... 52/378, 379, 512, 513, 508, 712, 52/713; 411/457, 460, 485, 923, 469, 470, 411/473
See application file for complete search history.

(56) References Cited

U.S. PATENT DOCUMENTS

| | | | | |
|---|---|---|---|---|
| 1,062,921 | A * | 5/1913 | Kinsel | 24/580.1 |
| 1,150,358 | A * | 8/1915 | Gilmer | 403/280 |
| 1,188,305 | A * | 6/1916 | Noerteman | 411/409 |
| 1,392,703 | A | 10/1921 | Phillips | |
| 1,798,468 | A | 3/1931 | Hartzler et al. | |
| 1,854,633 | A | 4/1931 | Stephens | |
| 1,819,156 | A * | 8/1931 | Fenton | 24/623 |
| 1,942,863 | A | 1/1934 | Johnstone | |
| 1,948,462 | A * | 2/1934 | Le Page | 24/581.11 |
| 2,240,117 | A | 4/1941 | Homolya | |
| 2,280,647 | A | 4/1942 | Hawes | |
| 2,403,566 | A | 7/1946 | Thorp et al. | |
| 2,554,326 | A * | 5/1951 | Dunn | 411/473 |
| 2,580,330 | A | 12/1951 | Symons | |
| 2,948,045 | A | 8/1960 | Imonetti | |
| 2,999,571 | A | 9/1961 | Huber | |
| 3,241,797 | A * | 3/1966 | Anderson | 248/71 |
| 3,292,336 | A | 12/1966 | Brynjolfsson et al. | |
| 3,341,998 | A | 9/1967 | Lucas | |
| 3,353,312 | A | 11/1967 | Storch | |
| 3,452,636 | A * | 7/1969 | Cohen et al. | 411/371.1 |
| 3,500,713 | A | 3/1970 | Bell | |

(Continued)

FOREIGN PATENT DOCUMENTS

| | | |
|---|---|---|
| CA | 1294457 | 1/1992 |
| CA | 1306116 | 8/1992 |

(Continued)

OTHER PUBLICATIONS

U.S. Appl. No. 11/143,037, Office Action dated May 4, 2007.

(Continued)

*Primary Examiner* — Robert Canfield
*Assistant Examiner* — Babajide Demuren
(74) *Attorney, Agent, or Firm* — Quarles & Brady LLP

(57) ABSTRACT

A spacer for an anchor includes a base having first and second sides. The first side is adapted for engagement with an anchor. At least two spikes extend from the second end of the base. An opening is provided within the base.

21 Claims, 14 Drawing Sheets

(56) References Cited

U.S. PATENT DOCUMENTS

| | | | | | |
|---|---|---|---|---|---|
| 3,523,395 | A | | 8/1970 | Rutter et al. | |
| 3,587,198 | A | | 6/1971 | Hensel | |
| 3,707,815 | A | | 1/1973 | Molyneux | |
| 3,786,605 | A | | 1/1974 | Winfrey | |
| 4,002,001 | A | | 1/1977 | Uydess | |
| 4,021,990 | A | | 5/1977 | Schwalberg | |
| 4,107,890 | A | | 8/1978 | Seghezzi et al. | |
| 4,108,560 | A | | 8/1978 | Minogue | |
| 4,329,823 | A | | 5/1982 | Simpson | |
| 4,350,464 | A | | 9/1982 | Brothers | |
| 4,422,617 | A | | 12/1983 | Gallis | |
| 4,426,061 | A | | 1/1984 | Taggart | |
| 4,430,035 | A | | 2/1984 | Rodseth | |
| 4,473,209 | A | | 9/1984 | Gallis et al. | |
| 4,473,984 | A | | 10/1984 | Lopez | |
| 4,598,518 | A | | 7/1986 | Hohmann | |
| 4,600,344 | A | | 7/1986 | Sutenbach et al. | |
| 4,606,163 | A | | 8/1986 | Catani | |
| 4,653,244 | A | | 3/1987 | Farrell | |
| 4,680,913 | A | | 7/1987 | Geisen et al. | |
| 4,736,554 | A | | 4/1988 | Tyler | |
| 4,764,069 | A | | 8/1988 | Reinwall et al. | |
| 4,765,108 | A | * | 8/1988 | Lapish | 52/379 |
| 4,793,335 | A | * | 12/1988 | Frey et al. | 623/13.14 |
| 4,795,294 | A | * | 1/1989 | Takada et al. | 411/457 |
| 4,825,614 | A | | 5/1989 | Bennett et al. | |
| 4,869,038 | A | | 9/1989 | Catani | |
| 4,869,043 | A | | 9/1989 | Hatzinikolas et al. | |
| 4,955,172 | A | | 9/1990 | Pierson | |
| 4,955,813 | A | * | 9/1990 | Fochler | 411/457 |
| 5,063,722 | A | | 11/1991 | Hohmann | |
| 5,207,043 | A | | 5/1993 | McGee et al. | |
| 5,209,619 | A | | 5/1993 | Rinderer | |
| 5,347,781 | A | | 9/1994 | Hanlon | |
| 5,392,581 | A | | 2/1995 | Hatzinikolas et al. | |
| 5,456,052 | A | | 10/1995 | Anderson et al. | |
| 5,671,578 | A | | 9/1997 | Hohmann | |
| RE35,659 | E | | 11/1997 | Ernst et al. | |
| 5,816,008 | A | | 10/1998 | Hohmann | |
| 5,836,126 | A | | 11/1998 | Harkenrider | |
| D406,524 | S | | 3/1999 | Steenson et al. | |
| 5,975,808 | A | * | 11/1999 | Fujita | 405/244 |
| 6,128,883 | A | | 10/2000 | Hatzinikolas | |
| 6,131,360 | A | | 10/2000 | Dalen | |
| 6,209,281 | B1 | | 4/2001 | Rice | |
| 6,279,283 | B1 | | 8/2001 | Hohmann et al. | |
| 6,332,300 | B1 | | 12/2001 | Wakai | |
| 6,401,406 | B1 | | 6/2002 | Komara | |
| 6,502,362 | B1 | | 1/2003 | Zambelli et al. | |
| 6,679,668 | B2 | * | 1/2004 | Martin et al. | 411/388 |
| 6,763,640 | B2 | | 7/2004 | Lane | |
| 6,802,675 | B2 | | 10/2004 | Timmons et al. | |
| D503,084 | S | * | 3/2005 | Jennings et al. | D8/387 |
| 6,925,768 | B2 | | 8/2005 | Hohmann et al. | |
| 6,941,717 | B2 | | 9/2005 | Hohmann et al. | |
| 7,114,900 | B2 | | 10/2006 | Toosky | |
| 7,404,274 | B2 | | 7/2008 | Hayes | |
| 7,415,803 | B2 | | 8/2008 | Bronner | |
| 7,562,506 | B2 | | 7/2009 | Hohmann, Jr. | |
| 7,587,874 | B2 | | 9/2009 | Hohmann, Jr. | |
| 7,717,015 | B2 | * | 5/2010 | Nilsen et al. | 81/176.2 |
| 2002/0098060 | A1 | * | 7/2002 | Kochlefl et al. | 411/429 |
| 2005/0279042 | A1 | * | 12/2005 | Bronner | 52/513 |
| 2005/0279043 | A1 | * | 12/2005 | Bronner | 52/561 |
| 2006/0005490 | A1 | * | 1/2006 | Hohmann, Jr. | 52/293.3 |
| 2009/0047098 | A1 | * | 2/2009 | Darling | 411/457 |

FOREIGN PATENT DOCUMENTS

| | | | |
|---|---|---|---|
| CA | 2 228 407 | | 7/1999 |
| DE | 231696 | | 6/1909 |
| DE | 1960453 | | 6/1970 |
| DE | 2856205 | | 10/1980 |
| JP | 52001363 | A * | 1/1977 |

OTHER PUBLICATIONS

U.S. Appl. No. 11/143,037, Office Action dated Aug. 24, 2007.

* cited by examiner

WINGED ANCHOR AND SPIKED SPACER FOR VENEER WALL TIE CONNECTION SYSTEM AND METHOD

CROSS REFERENCE TO RELATED APPLICATIONS

This application claims the benefit of U.S. Provisional Application Ser. No. 61/255,267, filed Oct. 27, 2009, and incorporated herein by reference in its entirety.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to an apparatus for transferring horizontal loads between a back-up structure and a veneer wall and, more particularly, to an anchor for directly applying horizontal loads to a back-up structure.

2. Description of the Background of the Invention

Much of today's construction of buildings requires a structural back-up wall to support horizontal transverse loads exerted by masonry veneer wall, e.g., brick veneer, stone veneer, etc. The back-up wall typically consists of stud wall, masonry wall, concrete wall, steel elements, etc. The veneer wall is supported horizontally by the back-up wall via masonry ties embedded in mortar joints on one end and attached to a tie anchor or a vertical tie anchor rail on the other end. The anchor is connected to the back-up wall and should be able to transfer the horizontal transverse loads, whether applied in tension or in compression, to the back-up wall. In some cases, the structural elements of the back-up wall are overlaid with wall sheeting and insulation boards, e.g., a metal stud wall may be overlaid with gypsum sheeting and insulation boards or a wood stud wall may be overlaid with plywood or similar sheeting with or without rigid insulation boards. However, existing systems suffer from several deficiencies, of which one is the inability to efficiently and economically transfer horizontal loads from the veneer wall directly to the structural elements comprising the back-up wall while at the same time sealing efficiently and economically the penetration through the wall sheeting against water and air transfer.

Indeed, one known prior art system for supporting a veneer wall against horizontal transverse loads includes bent plate clips. FIGS. 1 and 1A depict such bent plate clips 50, 50', respectively, which are adapted to be secured to a back-up wall about side 52 by way of a fastener (not shown) inserted through one or more holes 54. Holes 56*a*, 56*b* are also provided on the bent plate clip 50, 50' on a second side 58 thereof. The holes 56*a*, 56*b* are adapted to receive portions of a pintle style wire tie 60, which is depicted in FIG. 2. Specifically, the wire tie 60 includes a first end 62 and two bent arms 64*a*, 64*b* extending therefrom. Further, two legs 66*a*, 66*b* project from the bent arms 64*a*, 64*b*, respectively. During use, the legs 66*a*, 66*b* are inserted into the holes 56*a*, 56*b*, respectively, and the first end 62 and portions of the bent arms 64*a*, 64*b* rest within a mortar bed between two bricks of a veneer wall (not shown).

Another known prior art system includes plate anchors 70, 70', such as those shown in FIGS. 3 and 3A. The plate anchors 70, 70' include a rear plate 72 adapted to be secured to a back-up wall (not shown) by way of two fasteners (not shown) inserted through holes 74. The plate anchor 70' additionally includes two opposing legs 76, 78 for contact with the back-up wall. A center portion 80 of the rear plate 72 is partially cut and bent to create a slot 82 therebetween, which is adapted to receive portions of a wire tie 84 shown in FIG. 4. The wire tie 84, which has a generally trapezoidal shape, includes a first end 86 and two arms 88*a*, 88*b* extending therefrom. Further, two inwardly projecting ends 90*a*, 90*b* extend from the arms 88*a*, 88*b*, respectively. During use, the first end 86 is positioned within the slot 82 of the plate anchor 70, 70' and the projecting ends 90*a*, 90*b* and portions of the arms 88*a*, 88*b* rest within a mortar bed between at least two bricks of a veneer wall (not shown).

The present invention will disclose new anchors and new methods to install prior art anchors, which will assist in efficiently transferring horizontal loads from a veneer wall directly to the structural elements of a back-up wall while at the same time sealing the penetration through the wall sheeting. The new anchors and methods will do so in a less costly and more efficient manner than prior art anchors and methods. Further, the new anchors and methods have many additional advantages that will be explained in further detail hereinbelow.

SUMMARY OF THE INVENTION

In accordance with one aspect of the present invention, a spacer for an anchor includes a base having first and second sides. The first side is adapted for engagement with an anchor. At least two spikes extend from the second end of the base. An opening is provided within the base.

In accordance with another aspect of the present invention, an anchor includes a central barrel having first and second ends. An engagement portion having a recess is provided adjacent the first end. First and second side wings having first and second openings, respectively, extend laterally from the central barrel. A base has first and second sides, wherein the first side is adapted for receipt within the recess of the engagement portion of the central barrel. A plurality of spikes extend from the second end of the base. An opening extends through the central barrel and the base.

In accordance with yet another aspect of the present invention, a system includes a back up wall and a veneer wall spaced from the back up wall. An anchoring fastener has a first end secured to the back up wall and a second free end projecting into a space between the back up wall and the veneer wall. An anchor includes a central barrel with a bore extending therethrough and first and second side wings extending laterally from the central barrel. First and second openings are provided within the first and second side wings, respectively. A wire tie extends between the anchor and the veneer wall. The anchoring fastener extends through the bore of the anchor and the anchor is disposed adjacent a surface of the back up wall.

DETAILED DESCRIPTION OF THE PREFERRED EMBODIMENTS

Back-up walls typically consist of stud walls, masonry walls, concrete walls, steel elements, etc. An anchor is attached to the back-up wall for receipt of a wire tie, which is embedded in a mortar joint of a veneer wall. In some cases, the structural elements of the back-up wall are overlaid with wall sheeting and/or insulation boards. For purposes of clarity of illustration, the systems and methods of the present disclosure will be described in connection with a brick veneer wall attached to a back-up wall consisting of vertical wood studs overlaid with plywood boards or steel studs overlaid with gypsum boards. In some examples, insulation may be provided as well. However, it should be understood that the present anchors and methodologies described herein may be used in connection with any type of back-up wall or veneer wall known to one of skill in the art.

Figure 2:
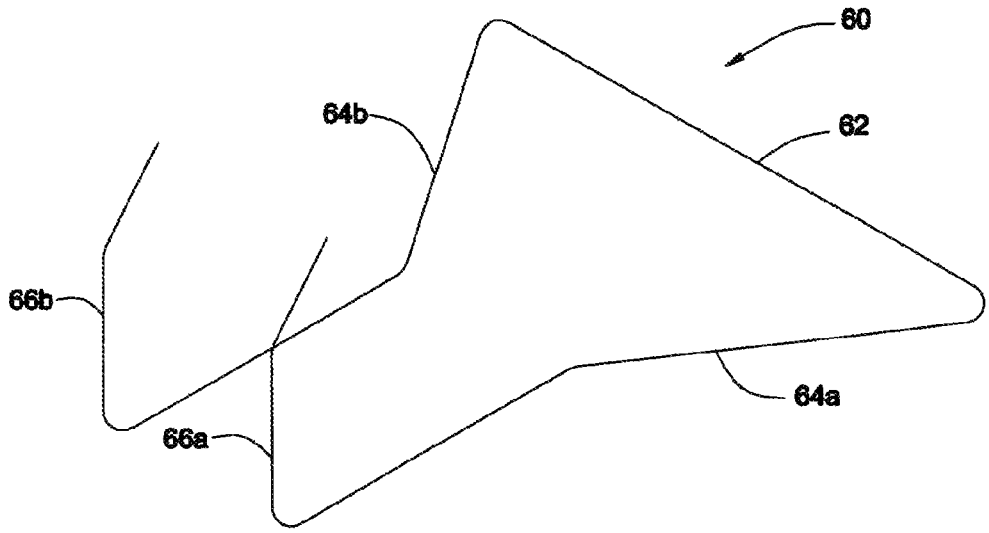
FIGURE 2 (Prior Art)
FIG. 2 is an isometric view of one embodiment of a wire tie that may be used in a load transfer system.
Figure 5:
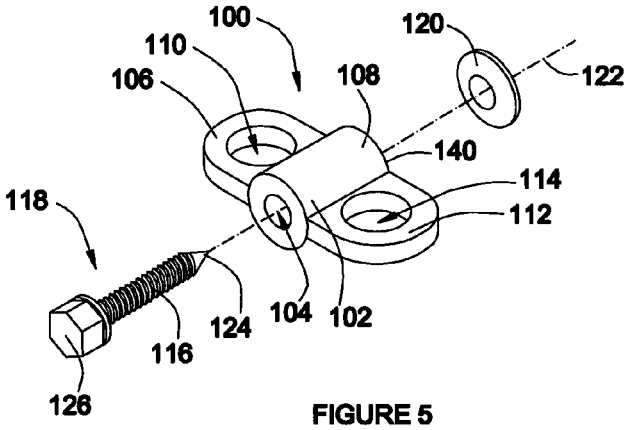
FIG. 5 is an exploded isometric view of a winged anchor in combination with an anchoring fastener and a washer.
Figure 6:
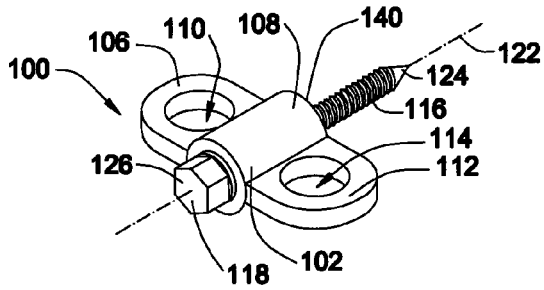
FIG. 6 is an isometric view of the winged anchor and anchoring fastener of FIG. 5.
Figure 7:
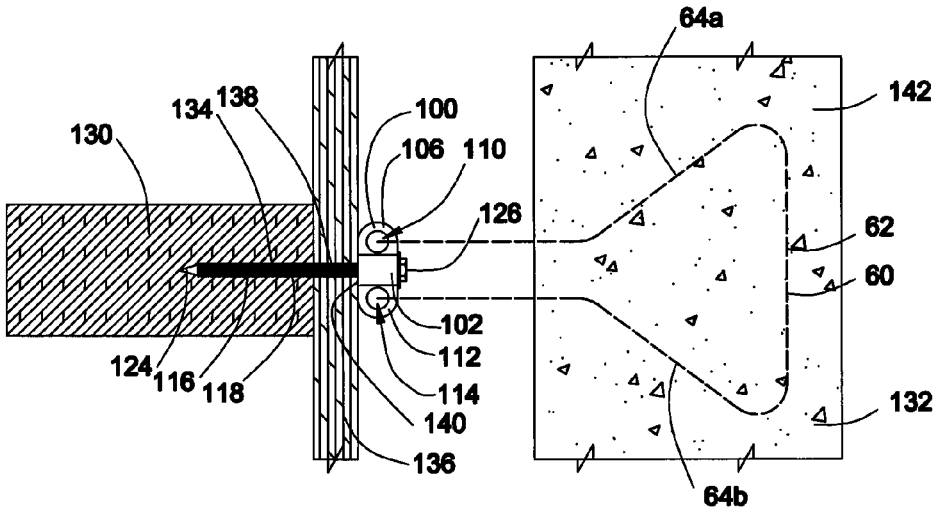
FIG. 7 is a fragmentary plan view, partly in section, of the winged anchor and anchoring fastener of FIG. 6, a back-up wall and wall sheeting, and a schematic representation of a wire tie and veneer wall.

Referring to FIGS. 5-7, a wire tie receiving body or winged anchor 100 is shown that is similar in its shape to the wing nuts disclosed in U.S. Pat. No. 7,415,803, which is incorporated by reference herein in its entirety. However, the winged anchor 100 includes a central barrel 102 that has an unthreaded bore 104. A generally planar first wing 106 extends laterally from an external side surface 108 of the central barrel 102. A hole 110 is provided in the first wing 106 through which the wire tie leg 66*a* (see FIG. 2) may extend. Similarly, a generally planar second wing 112 with a hole 114 for receipt of the wire tie leg 66*b* extends laterally from an opposite side of the central barrel 102. The wings 106, 112 are preferably spaced apart circumferentially by approximately 180 degrees to receive the legs 66*a*, 66*b* of the wire tie 60. It should be noted, however, that other spacings may be possible and that the central barrel 102, while generally illustrated as cylindrical, could instead be any geometric shape. The winged anchor 100 may be constructed from any suitable material, such as cast metal, e.g., Zamac, from cold formed metal, or molded from a plastic material, e.g., plastic material with or without glass fibers.

A threaded region 116 of an anchoring fastener 118 is pushed through the unthreaded bore 104 of the winged anchor 100. Optionally, one or more washers 120 (FIG. 5) may be disposed on the anchoring fastener 118. Rotational movement of the winged anchor 100 is possible to angularly orient the planar wings 106, 112 to a suitable position. Rotational movement of the winged anchor 100 is preferably accomplished prior to fully tightening the anchoring fastener 118.

In the present embodiment the anchoring fastener 118 comprises a conventional screw that includes a hexagonal head extension 126 that may fit within a socket of a hand or power tool to facilitate rotational movement of the anchoring fastener into a back-up wall 130 (FIG. 7). It is to be understood that a fastener with any other conventional fastener head can be used as well. The length of the anchoring fastener 118, the length and dimensions of the threaded portion 116, and the tip 124 are all suited for rotational insertion into the particular wood stud comprising the back-up wall 130. However, other types of anchoring fasteners 118 with different head styles or different means for securement, e.g., self drilling, self tapping, screws adapted to be secured in pre-drilled holes, etc., may be used in connection with similar or different back-up walls.

Referring to FIG. 7, the winged anchor 100 is shown connecting the back-up wall 130 to a veneer wall 132 for transfer of horizontal loads therebetween. Specifically, the tip 124 and portions of the threaded portion 116 are secured within a hole 134 in the back-up wall 130 formed by drilling the anchoring fastener 118 therein. The anchoring fastener 118 also extends through a layer of hard wall sheeting 136 by way of a hole 138 formed during the drilling procedure. The anchoring fastener 118 is drilled into the hard wall sheeting 136 and the back-up wall 130 until a distal end 140 of the winged anchor 100 or the washer 120 is secure adjacent the wall sheeting 136. During the fastening process the winged anchor 100 is held so that the wings 106, 112 are retained in an approximately level position. The legs 66*a*, 66*b* of the wire tie 60 (FIG. 2) are disposed in the holes 110, 114, respectively, of the winged anchor 100. As shown in FIG. 7, the first end 62 of the wire tie 60 and portions of the bent arms 64*a*, 64*b* rest within a mortar bed 142 between two bricks of the veneer wall 132.

The securement system and method of FIGS. 5-7 is particularly advantageous in situations where the back-up wall 130 is exposed or has bare masonry wall, bare concrete wall, or bare plywood, particle board, or any other hard sheeting supported by the back-up wall or other structural elements thereof. The anchoring fastener 118 assists in resisting tensile forces. The compressive forces are transferred directly through the contact surface between the winged anchor 100 and the backup wall sheeting 136. In instances where the wall sheeting is relatively soft, such as gypsum board or rigid insulation, and cannot resist the compressive forces applied by the anchor directly, other methods are used as described below.

Figure 8:
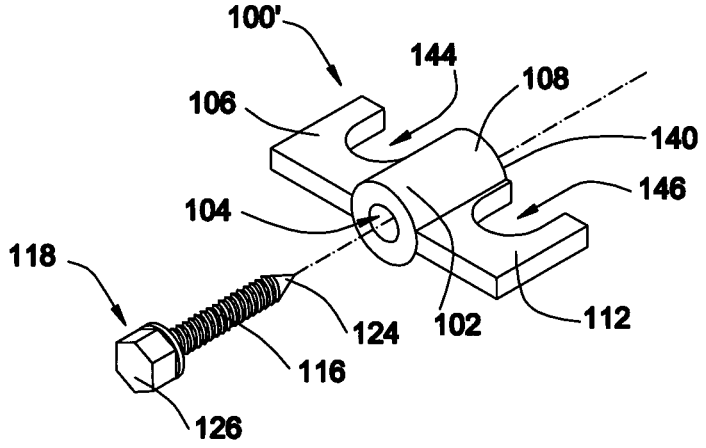
FIG. 8 is an exploded isometric view of a second embodiment of a winged anchor with an anchoring fastener.

FIG. 8 depicts a second embodiment of a winged anchor 100', which is identical to the winged anchor 100 except for the following differences. The holes 110, 114 in the wings 106, 112 have been replaced by grooves 144, 146, respectively, that extend to the distal end 140 of the winged anchor 100'. While the same pintle style wire tie 60 may be used in connection with the winged anchor 100', when the winged anchor 100' is secured adjacent a back-up wall, the compressive forces will be transferred directly through the contact surface between the legs 66*a* and 66*b* of the wire tie 60 and the face of the backup wall sheeting 136. However, the winged anchor 100' will resist forces in tension in a similar manner as the winged anchor 100.

Figure 9:
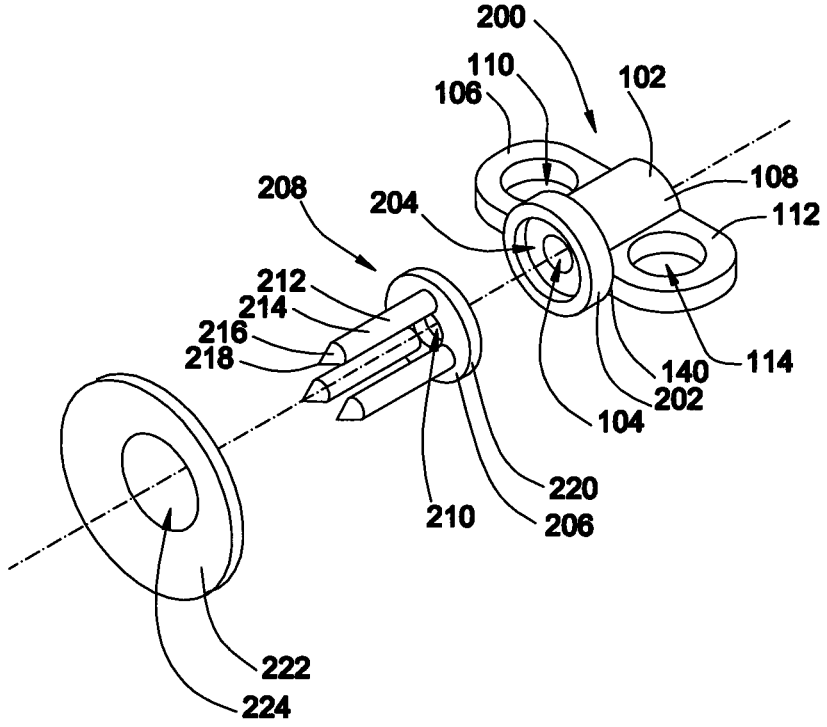
FIG. 9 is an exploded isometric view of another embodiment of a winged anchor with a spiked spacer and a washer.

Turning to FIG. 9, a different embodiment of a winged anchor 200 is shown, which is similar to the winged anchor 100 except for the inclusion of an optional cylindrical portion 202 on the distal end 140 thereof. The cylindrical portion 202 includes a cylindrical recess 204 adapted to receive a corresponding cylindrical base 206 or spike ring of a spiked spacer 208. In a preferred embodiment, the cylindrical base 206 has a diameter of from about 1.0 cm to about 2.5 cm. In alternative embodiments the diameter may be greater or smaller or the base 206 and the cylindrical portion 202 may be modified to have a different corresponding geometric shape, such as a square or hexagon. The cylindrical base 206 includes a hole 210 to allow passage of an anchoring fastener similar to those noted above. At least two spikes 212 are provided on the cylindrical base 206. In the present embodiment, three equidistantly spaced spikes 212 are provided on the cylindrical base 206. Each spike 212 includes a cylindrical shaft 214 with a constant diameter, which in a preferred embodiment is from about 0.25 cm to about 1.0 cm. In other embodiments one or more of the spikes 212 may include a tapering cross-section and/or may be a different geometric shape. The spikes 212 include a narrowed tip 216 that may have a blunt end 218 thereon for communication with plywood, particle board, or any other similar non-fully rigid back-up sheeting. However, in other embodiments a sharp pointed end is preferable. The spikes 212 are preferably disposed inwardly from an outer circumference 220 of the cylindrical base 206 so that a washer 222 may be provided thereon. Specifically, the washer 222 includes an opening 224 with a diameter large enough to allow passage of all of the spikes 212 therethrough, but that is small enough to not pass by the outer circumference 220 of the cylindrical base 206 so as to rest on same.

Figure 10:
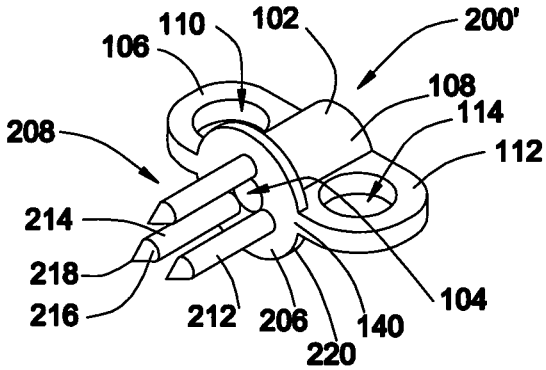
FIG. 10 is an isometric view of the winged anchor of FIG. 5 integrally combined with a spiked spacer.

The spikes 212 may be formed from the same types of materials as used to create the winged anchor 200, i.e., plastic or metallic materials. Indeed, in some embodiments the spikes 212 are formed integrally with a winged anchor, such as the winged anchor 200' shown in FIG. 10. In lieu of the cylindrical portion 202 and the cylindrical recess 204, the cylindrical base 206 is integral with the winged anchor 200'. While the spikes 212 and the remainder of the winged anchor 200' are typically fashioned from similar materials, in some cases the spikes 212 are made of metal while the remainder of the winged anchor 200' is made from a plastic material and attached to the spikes 212 during the molding process by methods known to those of skill in the art.

Figure 11:
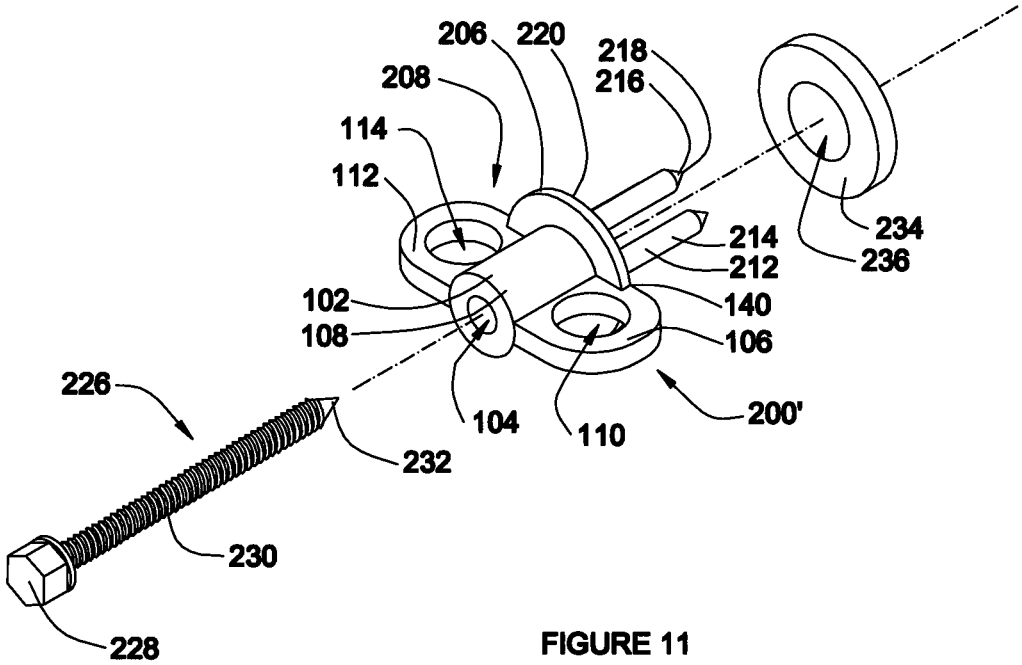
FIG. 11 is an exploded isometric view of the winged anchor of FIG. 10 with a washer and an anchoring fastener.

FIG. 11 depicts the winged anchor 200' with another embodiment of an anchoring fastener 226 similar to the anchoring fastener 118 described above. In the present embodiment the anchoring fastener 226 comprises a conventional screw that includes a hexagonal head extension 228, a threaded portion 230, and a tip 232 for insertion into a wood stud back-up wall. Further, a different embodiment of a washer 234, similar to the washer 222 described above, is provided, which includes a hole 236 for receipt of the anchoring fastener 226 and the spikes 212. While use of a washer is optional, washers of varying thickness may be used to compensate for variable field conditions. For example, when a ½ in. thick gypsum board sheeting is used in one instance and a ⅝ in. thick gypsum board sheeting is used in another instance, the same winged anchor can be used by providing a washer of the appropriate thickness.

Figure 12:
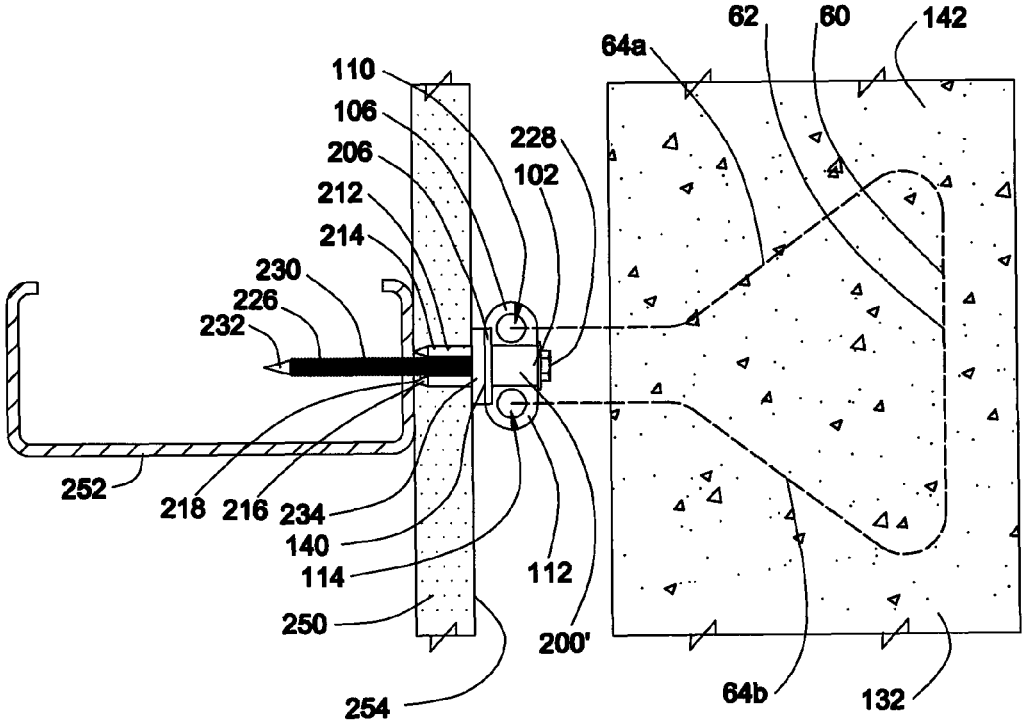
FIG. 12 is a fragmentary plan view, partly in section, of the winged anchor of FIG. 10, a back-up wall and wall sheeting, and a schematic representation of a wire tie and veneer wall.

With reference to FIG. 12, the winged anchor 200' will be shown in an operational state. During use, the spikes 212 of the winged anchor 200' are driven through wall sheeting 250, which in the present embodiment comprises a relatively soft sheeting such as gypsum board. As noted above, the present system and method may be used with any wall sheeting material or back-up wall, which may also include waterproof membranes and/or rigid insulation. The spikes 212 may be pushed manually through the wall sheeting 250 or may be tapped by a hammer. The spikes 212 are designed to penetrate the relatively soft sheeting overlying the structural elements of a back-up wall 252, which in this example is a metal stud wall, so that the tips 218 of the spikes 212 rest against the hard load-resisting structural elements of the back-up wall 252. In an alternative embodiment, the spiked spacer 208 is driven through the wall sheeting 250 in a similar manner and the cylindrical base 206 is fitted within the cylindrical recess 204 of the winged anchor 200. In both embodiments, portions of the cylindrical base 206 are preferably exposed adjacent a face 254 of the wall sheeting 250. Thereafter, an anchoring fastener is inserted through the winged anchors 200, 200' and secured to the back-up wall 252. Any of the winged anchors 200, 200' may be equipped with a washer, e.g., washer 224 or 234, so as to seal the penetration hole and successfully transfer the loads. The winged anchors 200, 200' may be longitudinally and angularly secured and placed in communication with the wire tie 60 and the veneer wall 132 in a similar manner as noted above. Upon being placed in an operational state, compression forces applied to the winged anchors 200, 200' are transferred directly through the contact surface between portions of the winged anchors 200, 200' in physical communication with the spikes 212, which in turn transfer the compressive forces directly to the back-up wall 252 structural elements. The anchoring fastener 226 assists in resisting tensile forces and in keeping the spikes 212 and the winged anchors 200, 200' in place.

Figure 1:
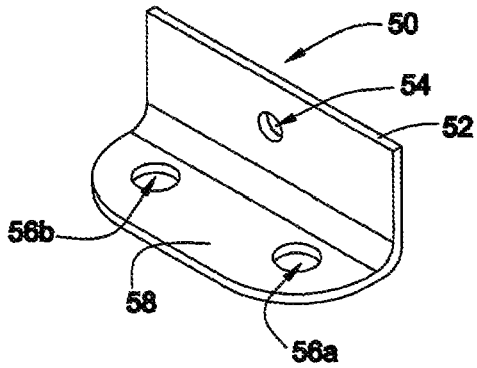
FIGURE 1 (Prior Art)
FIGS. 1 and 1A are isometric views of prior art bent plate clips.
Figure 1A:
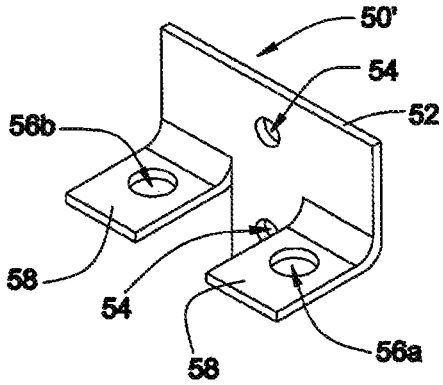
FIGURE 1A (Prior Art)
Figure 3:
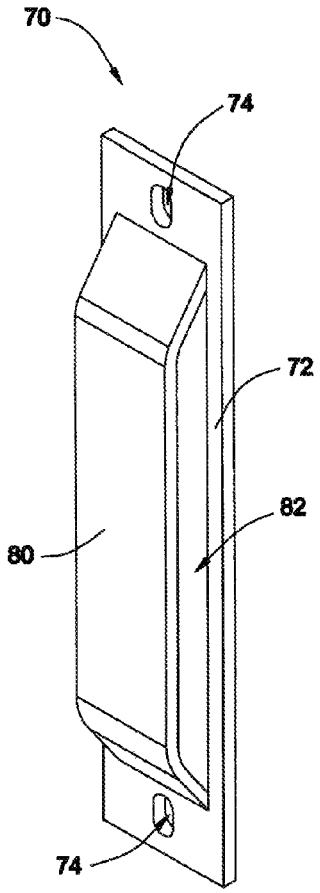
FIGURE 3 (Prior Art)
FIGS. 3 and 3A are isometric views of prior art plate anchors.
Figure 3A:
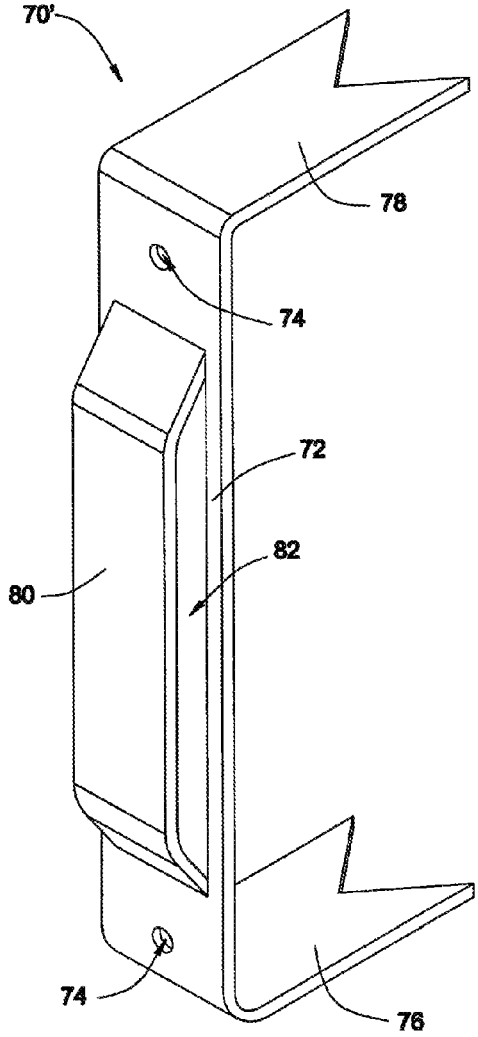
FIGURE 3A (Prior Art)

The presently described system and method has numerous advantages over the prior art. For example, the prior art anchors depicted in FIGS. 1 and 3 must be directly attached to structural elements of a back-up wall to efficiently transfer transverse forces to the back-up wall, as opposed to the presently disclosed winged anchors 200, 200' that allow for a spiked spacer 208 to assist in directly transferring forces through wall sheeting or other materials. Further, the winged anchors 100, 100', 200, 200' only require a single anchoring fastener to install as opposed to prior art plate anchors (FIGS. 3 and 3A) and some prior art bent plate clips (FIG. 1A), which require two fasteners. Indeed, the present system also allows for forces to be applied concentrically about an anchoring fastener to allow for efficient transfer of forces to the back-up wall. Therefore, the load on the winged anchors 100, 100', 200, 200' approximately equals the load on the anchoring fastener. In prior art systems, such as the one shown in FIG. 1, the fastener used to attach the anchor to a back-up wall is eccentric, thus the force applied to the fastener may be much bigger than the force actually applied to the anchor. To compensate for this effect, some prior art anchors require much stronger fasteners to resist the same amount of force, which increases the cost of installation. Even in prior art systems that keep the load and the fastener concentric, such as shown in FIG. 3 or 3A, the system requires the use of two fasteners as opposed to the single fastener in the present system, which also increases the cost of installation. Yet another disadvantage to prior art systems is that the prior art anchors are shaped from bent plates that make their design less efficient and result in greater internal bending moments than found in the winged anchors 100, 100', 200, 200' of the present system, which may be cast from metal or molded from plastic material and formed into the most efficient shape for the transfer of forces.

The present system also realizes advantages in the ability to manufacture the winged anchors 100, 100', 200, 200' from molded plastic, which will conduct less heat than metallic anchors. Further, the bore 104 may be similar or oversized in comparison to a diameter of the anchoring fastener. This will allow the same winged anchors 100, 100', 200, 200' to be used in connection with differently sized anchoring fasteners, which will result in savings for the producer in terms of manufacturing and stocking costs and savings for the user as well. An oversized bore 104 is possible because the connection of the system relies on the clamping action of the anchor between the anchoring fastener's head and the back-up wall. Also, as compared to prior art anchors such as the ones disclosed in U.S. Pat. Nos. 4,764,069, 7,415,803, and other similar anchors, the presently disclosed winged anchors 100, 100', 200 and 200' do not require any threaded parts except the standard fastener. This allows the central barrel 102 and bore 104 to be smaller on one the hand and eliminates the need for assembly of threaded parts on the other hand. All of these advantages provide for a less costly and more efficient production process. Finally, the ability to rotationally adjust the winged anchors 100, 100', 200, 200' in a manner as noted above also provides significant advantages over prior art systems.

Figure 13:
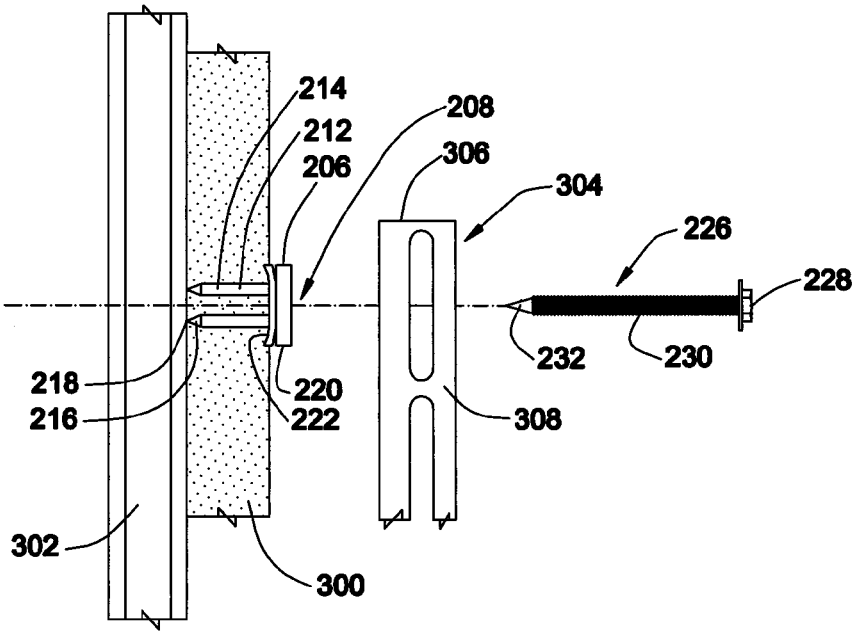
FIG. 13 is a fragmentary, side elevational view, partly in section, of the spiked spacer of FIG. 9, wall sheeting, and a back-up wall shown in an exploded state in combination with an anchor rail and the anchoring fastener of FIG. 11.
Figure 13:
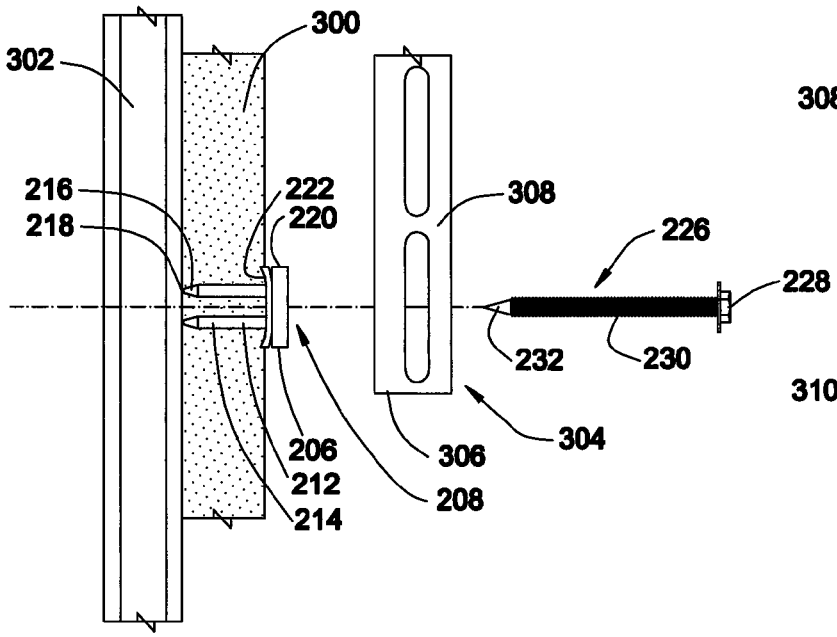
Figure 14:
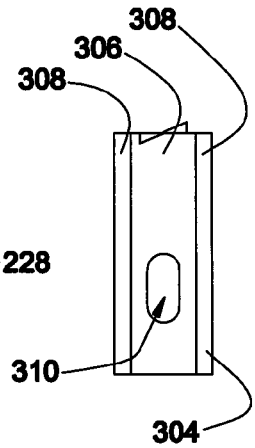
FIG. 14 is a fragmentary front elevational view of the anchor rail of FIG. 13.

It is also contemplated that the spiked spacers 208 of the above noted embodiments may be used in connection with prior art anchors to provide more efficient anchoring systems. For example, FIG. 13 shows two spiked spacers 208 as depicted in FIG. 9 with the spikes 212 inserted through wall sheeting 300, e.g., gypsum board, and in physical communication with a back-up wall 302, e.g., a metal stud wall. A conventional anchor rail 304 is provided (FIGS. 13 and 14), which includes a rear wall 306 and opposing side walls 308 that define a channel. Slots 310 are provided within the rear wall 306 that are adapted to receive the anchoring fasteners 226. The anchor rail 304 is disposed adjacent the spiked spacers 208 and the anchoring fasteners 226 are inserted through the slots 310, the holes 104, and secured within the back-up wall 302.

Figure 15:
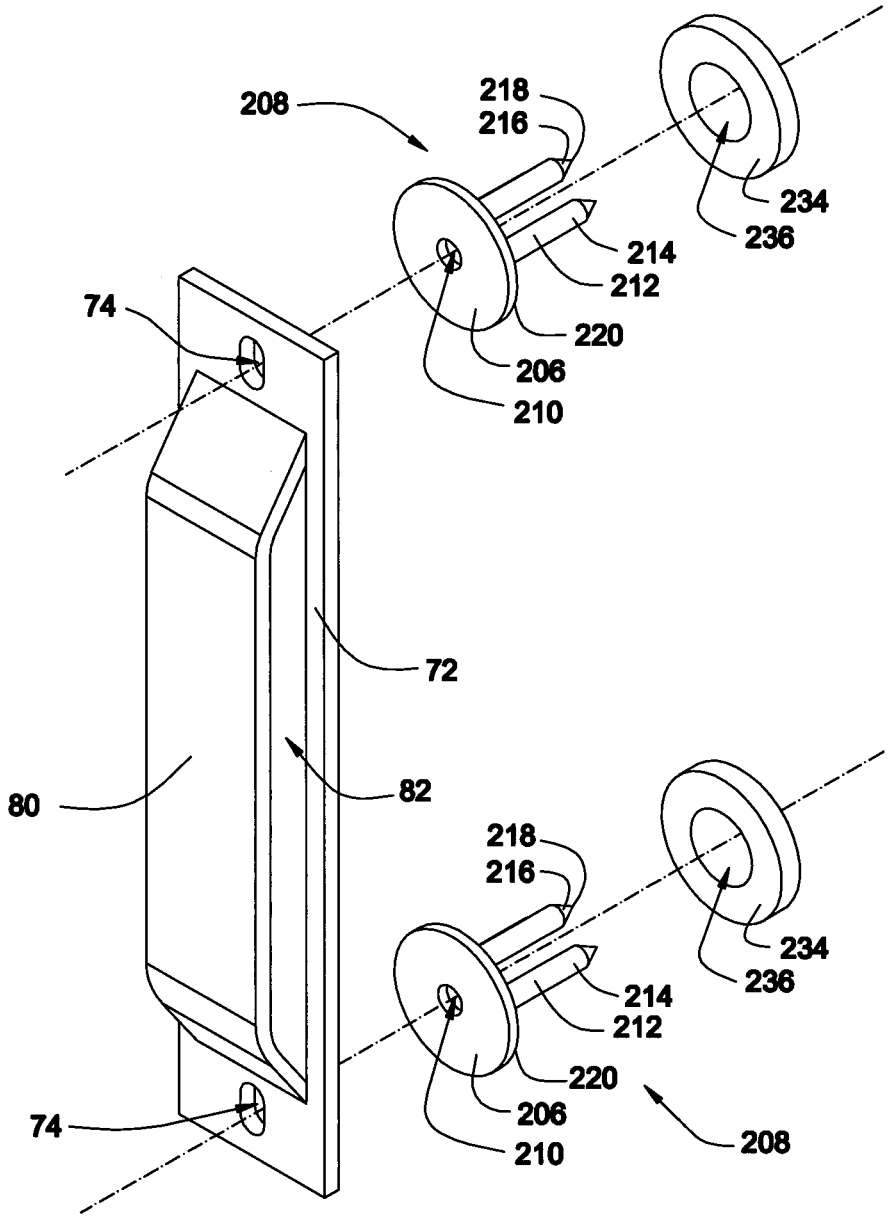
FIG. 15 depicts an exploded isometric view of the plate anchor of FIG. 3, the spiked spacer of FIG. 9, and the washer of FIG. 11.

FIG. 15 depicts how the prior art plate anchor 70 of FIG. 3 may be used in combination with the spiked spacer 208 and the washer 234. The modified plate anchor 70 has significant advantages over the prior art plate anchor 70', which includes opposing legs 76, 78 for contact with a back-up wall. The plate anchor 70' requires cutting horizontal slots into a wall sheeting to receive the legs 76, 78, which makes it difficult to seal the penetration holes and is more labor intensive. In contrast, a better seal and more efficient anchoring system may be realized by utilizing the spiked spacers 208 in connection with the plate anchor 70 as illustrated in FIG. 15. A seal of the penetration holes is achieved by installing the washers 234 in conjunction with the spiked spacers 208. Further, the plate anchor 70' is more costly to manufacture than the modified plate anchor 70 because of all the additional metallic material in the plate anchor 70'. Finally, because the slots 74 in the plate anchor 70' are not aligned with the legs 76, 78, unlike the concentric spikes 212 and the anchoring fastener 226 of the plate anchor 70 in FIG. 15, a bending moment is induced in the plate anchor 70' that weakens same.

Figure 16:
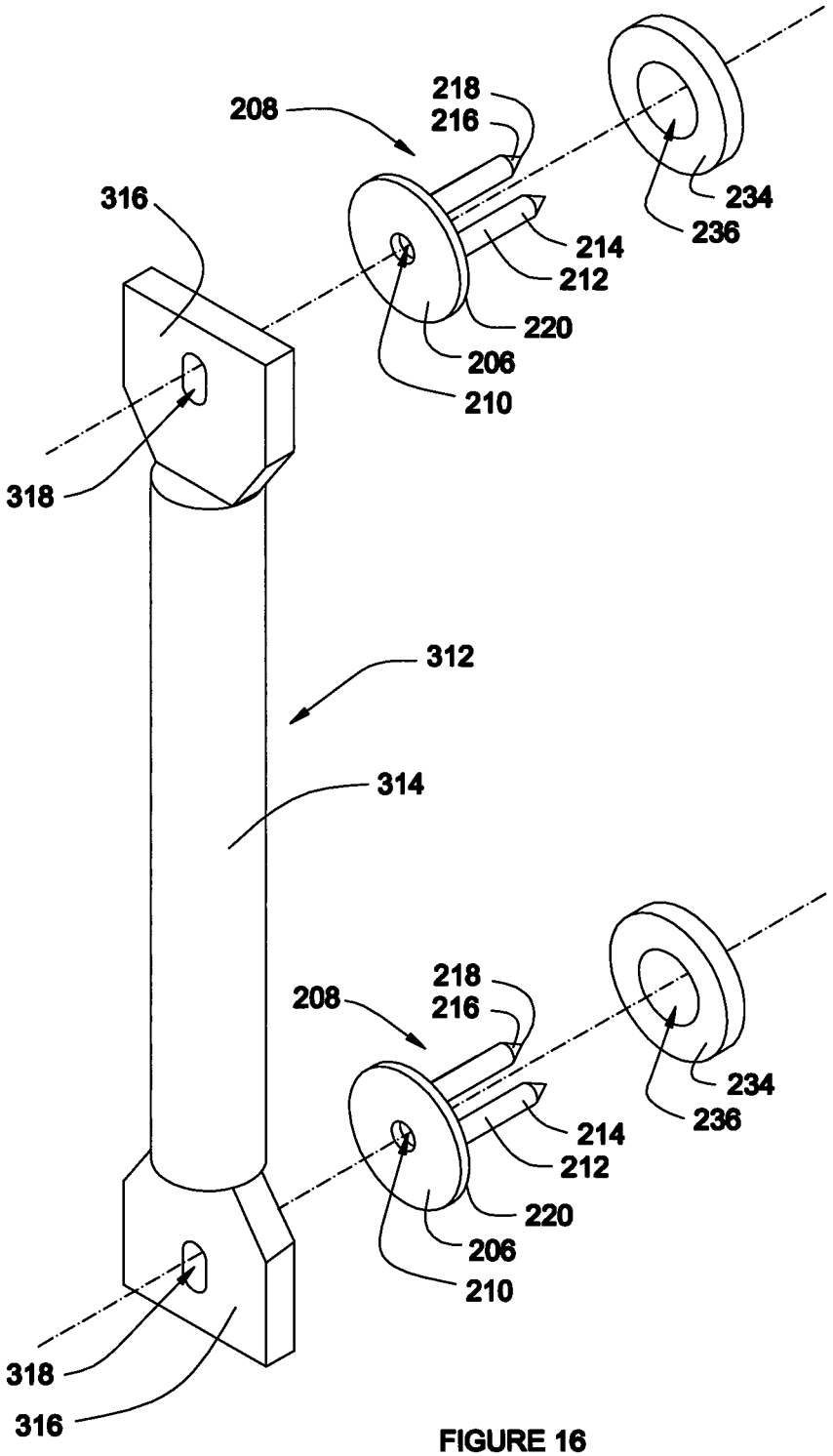
FIG. 16 is a view similar to the one depicted in FIG. 15 except for the replacement of the plate anchor with a round anchor rod with flattened ends.
Figure 17:
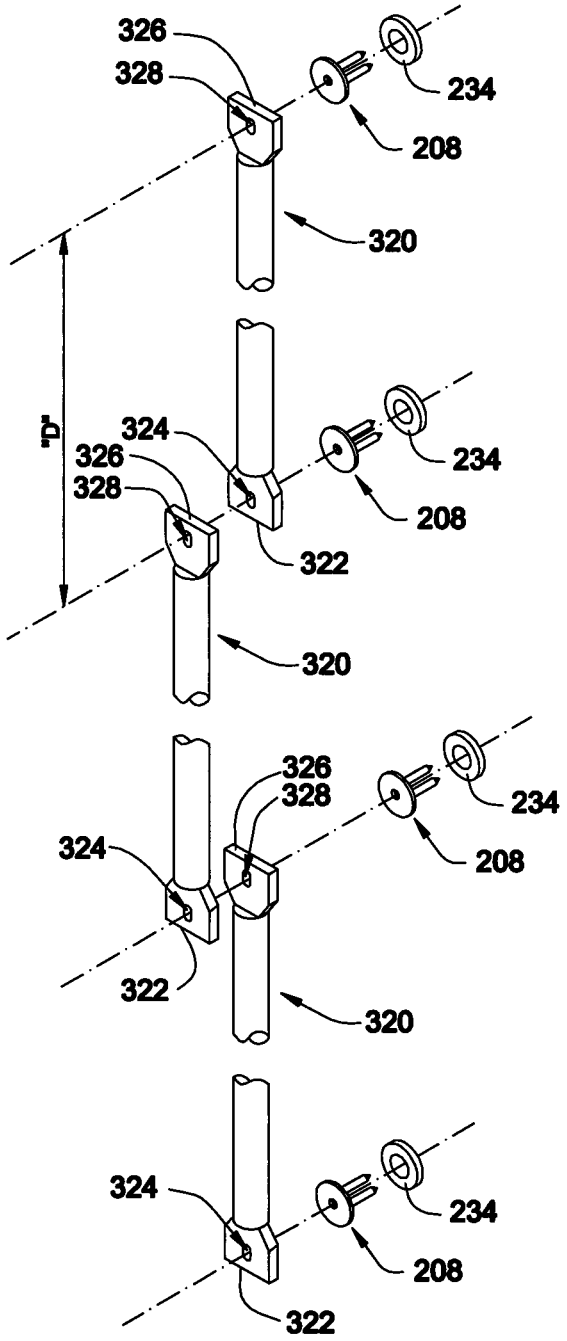
FIG. 17 is a fragmentary, exploded isometric view of a plurality of continuous rails, the spiked spacer of FIG. 9, and the washer of FIG. 11.

FIG. 16 depicts a similar arrangement as described in connection with FIG. 15 that replaces the plate anchor 70 by a round rod anchor 312. The round rod anchor 312 includes a cylindrical shaft 314 with flattened portions 316 on opposing ends thereof. Slots 318 are provided in each of the flattened portions for receipt of an anchoring fastener. Yet another embodiment is depicted in FIG. 17, which shows a plurality of continuous rails 320 provided in a vertical arrangement, wherein a first end 322 of each rail 320 includes a flattened portion provided with a slot 324 that is adapted to be aligned with a second end 326 of each rail 320 that includes a flattened portion provided with a slot 328. The spacing between the slots 324, 328 is identified by a distance D, which is a function of the strength of the rail 320, the strength of the anchoring fastener, as well as numerous other factors. In a preferred embodiment the distance D is about 16 in. Upon aligning the slot 324 of the first end 322 of one rail 320 with the slot 328 of the second end of a different rail 320, an anchoring fastener may be inserted through the slots 324, 328, the bore 304 of the spiked spacer 208, the hole 236 of the washer 234, and into a back-up wall.

Figure 4:
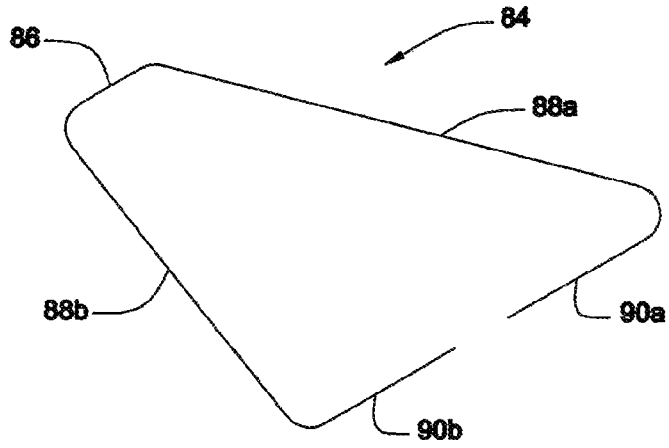
FIGURE 4 (Prior Art)
FIG. 4 is an isometric view of an alternative embodiment of a wire tie that may be used in a load transfer system.
Figure 18:
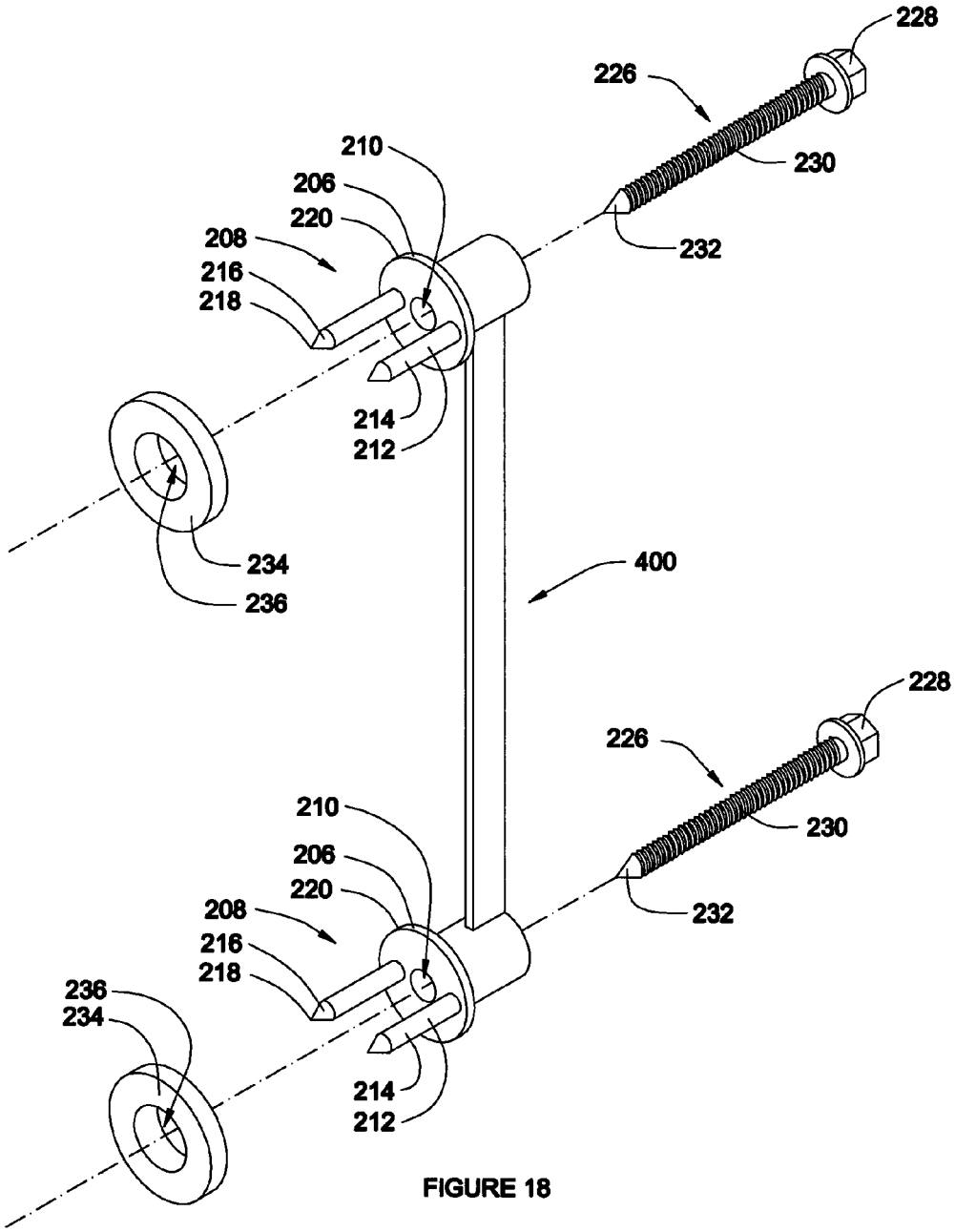
FIG. 18 is an exploded isometric view of a single rail anchor and the washer and the anchoring fastener of FIG. 11.
Figure 19:
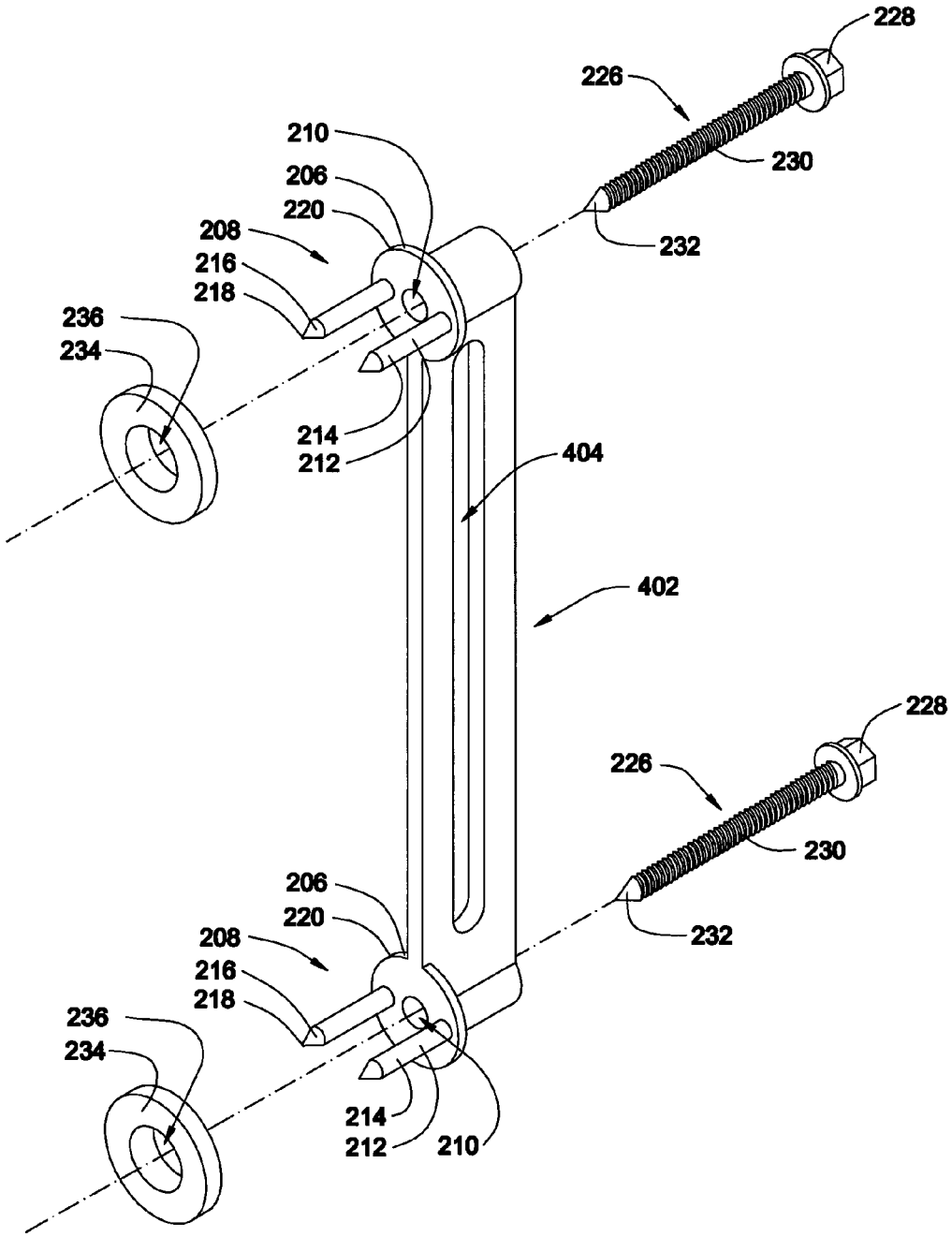
FIG. 19 is an exploded isometric view of a double rail anchor and the washer and the anchoring fastener of FIG. 11.
Figure 20:
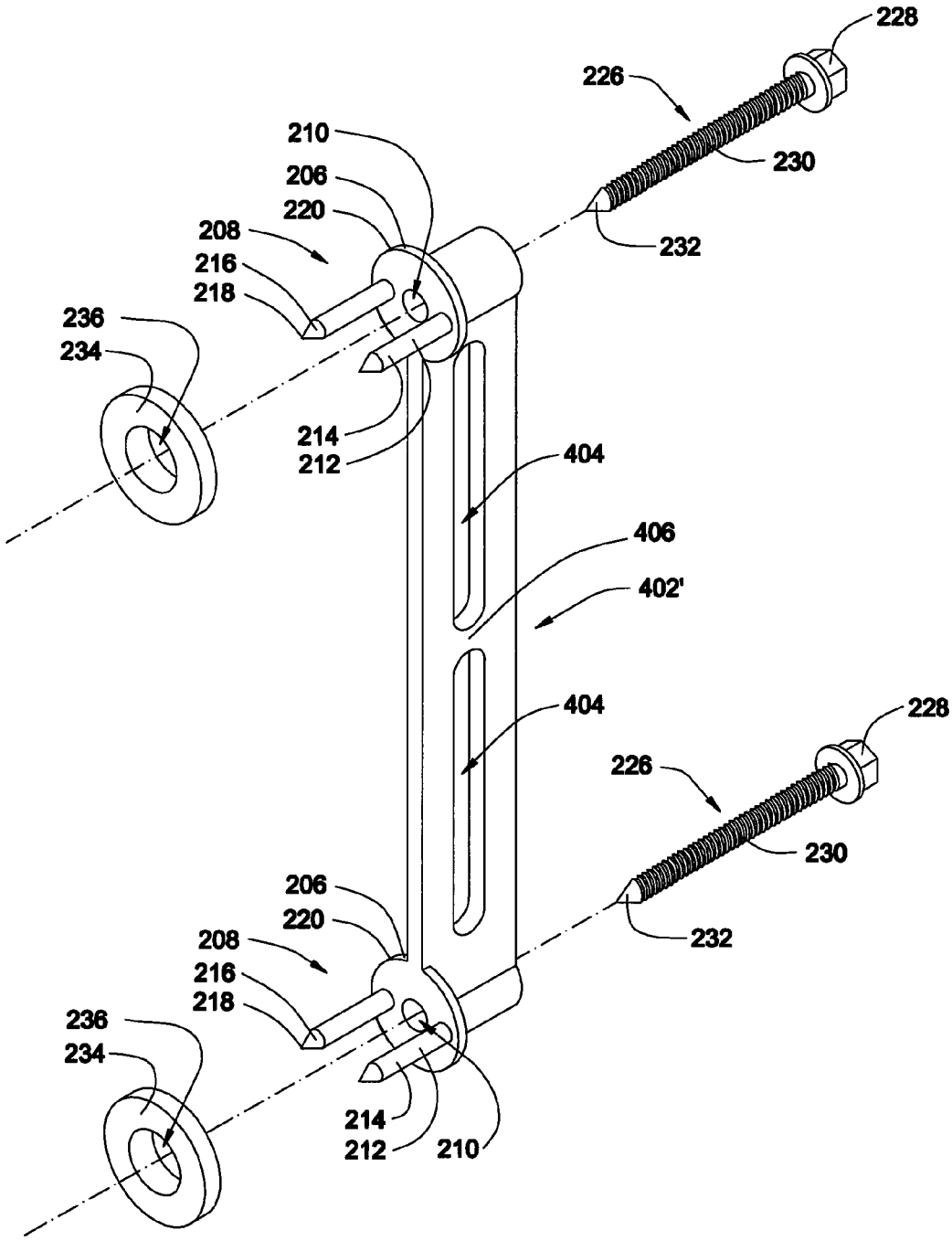
FIG. 20 is an exploded isometric view of the double rail anchor, the washer, and the anchoring fastener of FIG. 19 further including a reinforcing bridge connector.

In yet other embodiments, it is contemplated that the spiked spacer 208 will be formed integrally with prior art anchors. For example, FIG. 18 depicts opposing spiked spacers 208 formed integrally with a single rail anchor 400. Each of the spiked spacers 208 includes two opposing spikes 212 on the base 206 thereof. Twist-on ties, such as those manufactured by Heckmann Building Products of Melrose Park, Ill., may be used with the present single rail anchor 400, as well as the twist-on wire ties disclosed in U.S. Provisional Application No. 61/276,368, filed on Sep. 11, 2009, which is incorporated herein by reference in its entirety. A different embodiment of a double rail anchor 402 is shown in FIG. 19, which includes a slot 404 for receipt of a standard wire tie such as the one shown in FIG. 4 or the wire ties mentioned in connection with FIG. 18 above. Similarly, FIG. 20 depicts a double anchor rail 402', which includes two slots 404 separated by a reinforcing connector 406 that is adapted to receive any of the wire ties discussed in connection with FIG. 19. The modified anchors depicted in FIGS. 18-20 have considerable advantages over prior art anchors similar to those noted above. Further, the modified anchors as shown in FIGS. 18-20 may be manufactured from cast metal or molded from plastic material with embedded metal spikes as noted in connection with several of the embodiments discussed above.

Numerous modifications to the features described and shown are possible. Accordingly, the described and illustrated embodiments are to be construed as merely examples of the inventive concepts expressed herein.

I claim:

1. A spacer for an anchor, comprising:

a base having first and second sides, wherein the first side is in engagement with an anchor, and wherein the anchor includes at least one opening to receive a wire tie;

at least three spikes extending from the second side of the base, wherein at least one of the spikes has a cylindrical shaft with a narrowed tip at a distal end thereof; and an opening within the base.

2. The spacer of claim 1, wherein the base is cylindrical.

3. The spacer of claim 1, wherein the at least three spikes are equidistantly spaced around the opening within the base.

4. The spacer of claim 1, wherein the at least three spikes are disposed inwardly from an outer perimeter of the base.

5. The spacer of claim 4 further including a washer having an opening for receipt of the at least three spikes and wherein portions of the washer rest on the base adjacent the outer perimeter thereof.

6. The spacer of claim 1, wherein the at least three spikes comprise a plastic material.

7. The spacer of claim 1, wherein the at least three spikes comprise a metallic material.

8. The spacer of claim 1 further including an anchoring fastener extending through the opening within the base.

9. The spacer of claim 1, wherein the first side of the base is releaseably engaged with an anchor.

10. The spacer of claim 1, wherein the first side of the base is integrally engaged with an anchor.

11. The spacer of claim 9, wherein the first side of the base is releasably engaged with a first end of a central barrel having a bore in alignment with the opening of the base, and wherein first and second side wings having first and second openings, respectively, extend laterally from the central barrel.

12. The spacer of claim 9, wherein the first side of the base is releaseably engaged with one of a rail anchor, double rail anchor, round rod anchor, plate anchor, and winged anchor.

13. The spacer of claim 10, wherein the first side of the base is integrally engaged with a first end of a central barrel having a bore in alignment with the opening of the base, and wherein first and second side wings having first and second openings, respectively, extend laterally from the central barrel.

14. The spacer of claim 10, wherein the first side of the base is integrally engaged with one of a rail anchor, double rail anchor, round rod anchor, plate anchor, and winged anchor.

15. The spacer of claim 1, wherein the base further includes a sealing means.

16. A spacer for an anchor, comprising:

a circular base having first and second ends, wherein the first end is in engagement with an anchor having an opening adapted to receive a wire tie;

an opening within the base adapted to receive an anchoring fastener therethrough; and at least two spikes extending from the second end.

17. The spacer of claim 16, wherein the base is cylindrical.

18. The spacer of claim 16, wherein three spikes extend from the second end and are equidistantly spaced around the opening.

19. An anchor, comprising:

a barrel having first and second ends, wherein first and second side wings extend laterally from the barrel, and wherein the first and second wings are adapted to receive a wire tie;

a spacer having a base, wherein a first side of the base is engaged with the first end of the barrel;

an opening that extends through the barrel and the base, wherein the opening is adapted to receive an anchoring fastener therein; and a plurality of spikes extending from a second side of the base.

20. The anchor of claim 19 further including an anchoring fastener extending through the opening.

21. The anchor of claim 19, wherein three spikes extend from the second side of the base and are spaced equidistantly around the opening.

* * * * *